United States Patent [19]

Farrell

[11] 4,170,725

[45] Oct. 9, 1979

[54] SWITCH WITH SLIDING CONTACTOR

[75] Inventor: Guy M. Farrell, Elmhurst, Ill.

[73] Assignee: Chicago Switch, Inc., Chicago, Ill.

[21] Appl. No.: 894,830

[22] Filed: Apr. 10, 1978

[51] Int. Cl.[2] ..... H01H 13/28

[52] U.S. Cl. ..... 200/676; 200/275; 200/241

[58] Field of Search ..... 200/676, 239, 241, 252, 200/255, 260, 16 C, 16 R, 164 R, 68, 275

[56] References Cited

U.S. PATENT DOCUMENTS

| | | | |
|---|---|---|---|
| 1,892,542 | 12/1932 | Stearns | 200/68 |
| 2,027,538 | 1/1936 | Krieger | 200/68 |
| 2,432,647 | 12/1947 | Batcheller | 200/68 |
| 2,782,279 | 2/1957 | Heuss | 200/68 |
| 3,158,704 | 11/1964 | Sorenson | 200/164 R |
| 3,165,604 | 1/1965 | Sorenson | 200/164 R |
| 3,711,663 | 1/1973 | Sorenson | 200/676 |
| 4,127,754 | 11/1978 | Josemans et al. | 200/275 |

*Primary Examiner*—Richard E. Aegerter
*Assistant Examiner*—John W. Shepperd
*Attorney, Agent, or Firm*—McDougall, Hersh & Scott

[57] ABSTRACT

A switch construction including opposed contacts positioned on a base and a bridging contactor slidable between different switch positions. The design of the contacts on the base includes an upper section defining a first surface engageable by a tab formed on the sliding contactor. Second surface portions offset relative to the first surface provide engagement with shoulders defined by the sliding contactor. Resilient means press the sliding contactor against this upper section in a fashion such that the shoulders operate to limit the movement of the sliding contactor. The separate engagement of the tab and shoulders provide separate available current paths for the switch.

7 Claims, 7 Drawing Figures

SWITCH WITH SLIDING CONTACTOR

BACKGROUND OF THE INVENTION

1. Field of the Invention

This invention is related to switch constructions which involve the use of stationary and movable contacts. The invention is particularly concerned with constructions of this type wherein the movable contact is adapted to bridge opposed stationary contacts with the movable contact being adapted to slide between different positions. The switch may involve the use of two or more contacts whereby different current paths are provided. On the other hand, a switch position may involve an open contact.

It is desirable to provide switches which are quite small but which are still capable of handling sizeable current. It has been recognized, however, that such switches can be relatively expensive if they are to be considered reliable. One problem which is particularly significant is the occurrence of arcing which is, of course, more pronounced when higher currents are involved. When the arcing occurs, contacts may be contaminated whereby the switch function is materially impaired.

2. Description Of The Prior Art

Stearns U.S. Pat. No. 1,892,542, Batcheller U.S. Pat. No. 2,432,647 and Heusser U.S. Pat. No. 2,782,279 are representative of switches in the prior art which are characterized by a base having stationary contacts with a bridging contactor movable between different switch positions. In the case of the Stearns patent, the bridging contactor slides in response to the movement of a pivotally mounted, spring loaded, actuator. A fulcrum located between a pair of outside contacts results in pivoting movement of the bridging contactor in the course of its sliding movement. Batcheller and Heusser illustrate substantially one-piece contacts movable between different switch positions.

SUMMARY OF THE INVENTION

The particular switch construction of this invention comprises opposed contacts positioned on a base. A bridging contactor is supported over the base, and actuator means serve to move this contactor between first and second positions to achieve the switching operation.

The stationary contacts positioned on the base include one contact which functions as a fulcrum for the bridging contactor whereby the bridging contactor pivots when shifting between switch positions. At least one additional contact is located in spaced relationship relative to the fulcrum contact. This additional contact is characterized by an upper section which defines separate engaging surfaces offset relative to each other. The bridging contactor includes a shoulder portion movable into engagement with a first surface of the upper section and the bridging contactor also includes a tab section movable into engagement with the second surface of the upper section.

The respective engaging portions achieve separate functions in the switch operation. The engagement of the shoulder portion with the first surface serves as a means for limiting the extent of movement of the bridging contactor relative to the upper section of the stationary contact, and this insures that forces generated by the switch actuator are fully applied. Specifically, where a resilient means is associated with a pivoting switch actuator, the complete spring pressure will be available for insuring contact engagement.

The engagement between the tab section of the bridging contactor and the second surface operates to provide a separate current path once the switching operation has been completed. Thus, the switch provides redundancy which is important for minimizing switch malfunction. In addition, the movement of the tab relative to the second switch surface provides a wiping action thereby minimizing the build-up of contamination.

DESCRIPTION OF THE PREFERRED EMBODIMENT

Figure 1:
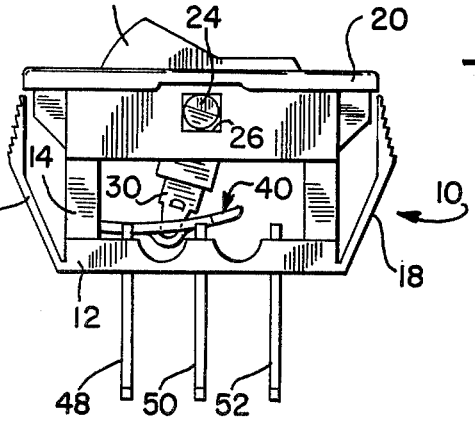
FIG. 1 comprises a side view of a switch construction characterized by the features of this invention with a side wall removed.

The drawings illustrate a switch 10 comprising a molded housing including a base 12, end walls 14 and side walls 16. A pair of legs 18 are formed integrally with the base, and these legs are adapted to be pressed inwardly so that the switch can be forced into an opening defined in a panel with the flange 20 limiting the inward movement and with the resilient legs pressing outwardly to hold the switch in place.

A molded actuator 22 includes trunnions 24 which are received in openings 26 defined by side walls 16. The actuator defines an internal bore 28 which receives piston 30. In addition, spring 32 is received within the bore 34 formed in the piston. This spring thus normally urges the piston outwardly relative to the actuator.

Figure 2:
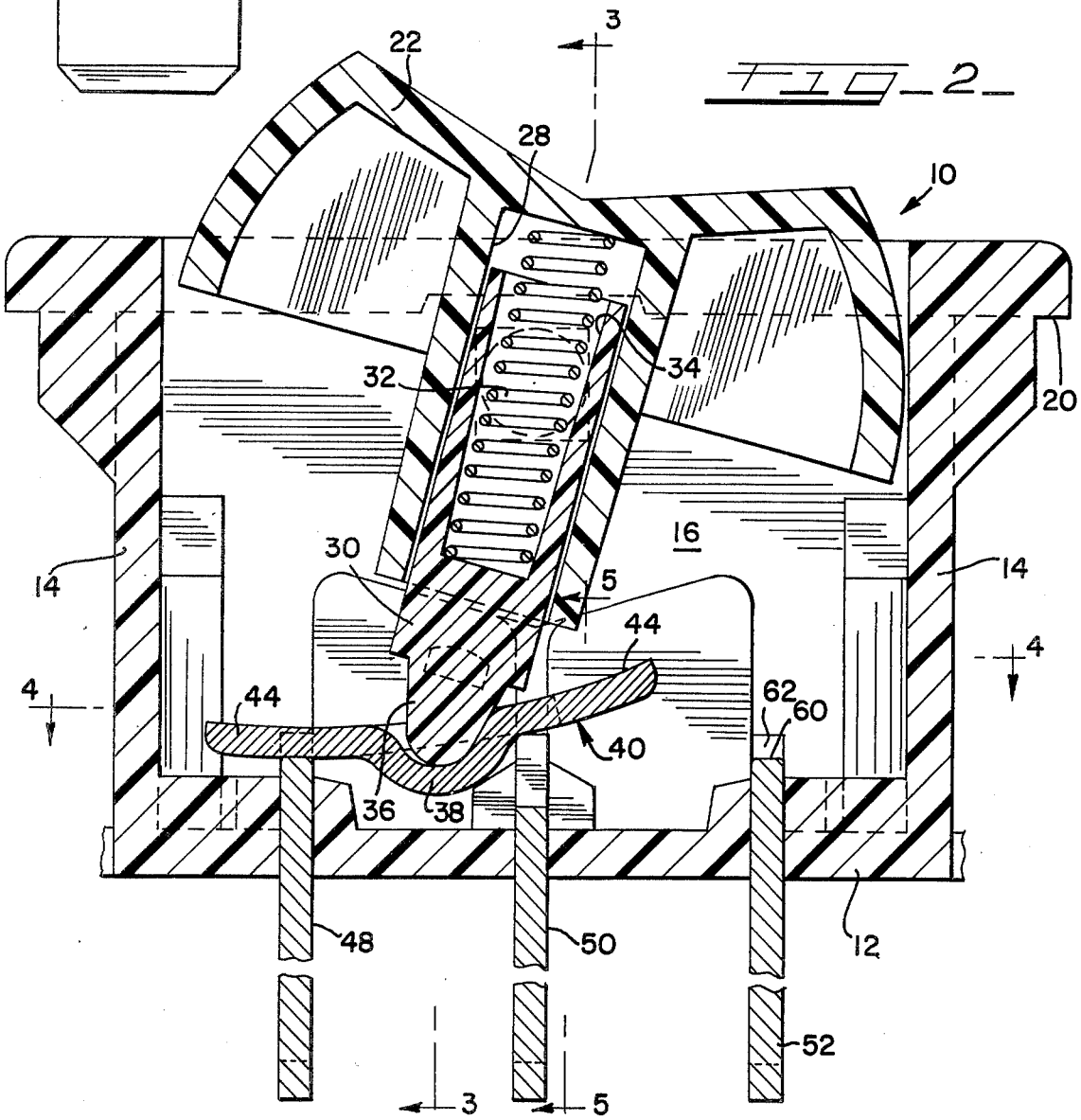
FIG. 2 is an enlarged vertical, sectional view of the switch construction.
Figure 3:
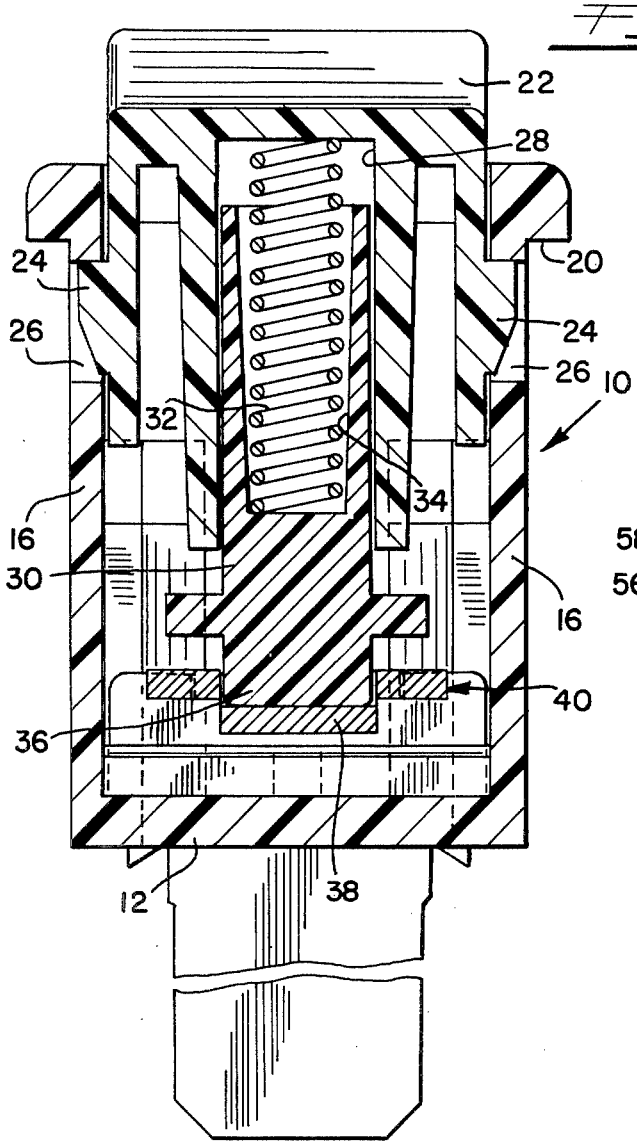
FIG. 3 is a cross-sectional view taken about the line 3—3 of FIG. 2.
Figure 5:
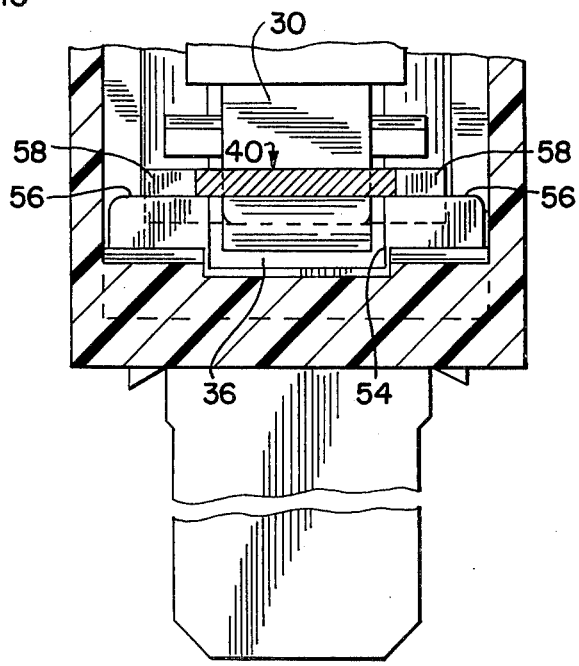
FIG. 5 is a fragmentary, cross-sectional view taken about the line 5—5 of FIG. 2.
Figure 4:
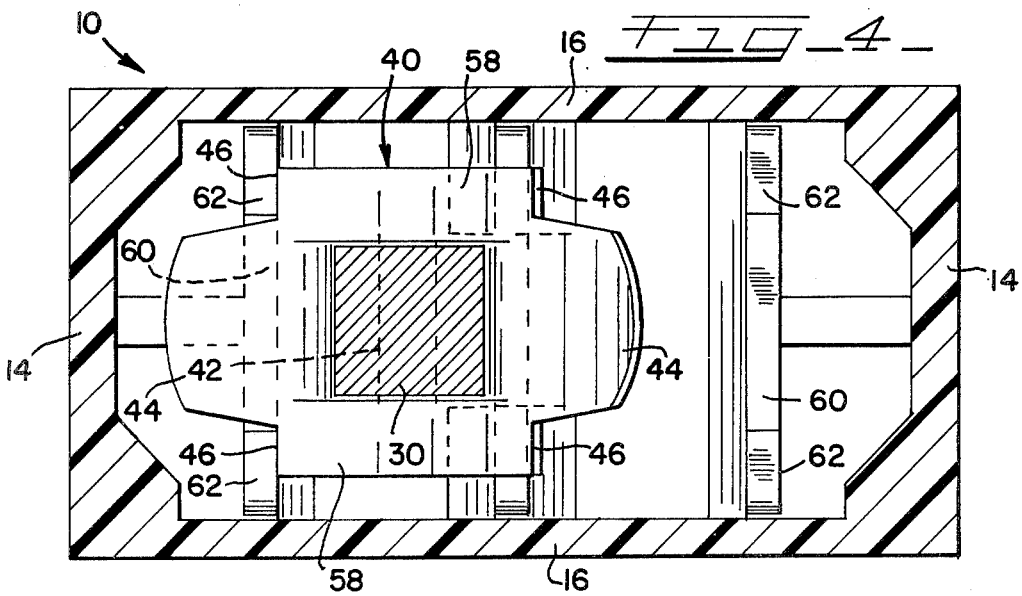
FIG. 4 is a cross-sectional view taken about the line 4—4 of FIG. 2.

The piston defines a nose 36 which is received by hammock 38 formed in bridging contactor 40. The bridging contactor 40 includes a pair of outwardly extending tab sections 44. Shoulders 46 are defined on opposite sides of each tab section. As best shown in FIG. 2, the length of the contactor 40 is such that it easily bridges the upper ends of a pair of stationary contacts supported on the base 12. These stationary contacts include outer contact 48, and intermediate contact 50, and another outer contact 52.

Figure 7:
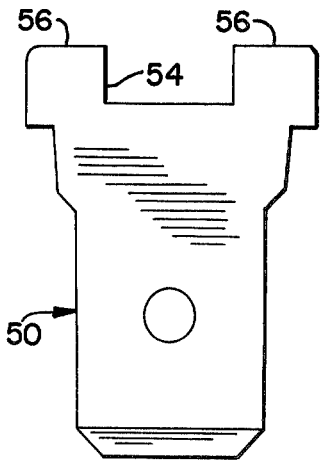

FIG. 7 illustrates the structure of intermediate contact 50. This contact, in particular, includes an upper section defining cutout portion 54 and bearing surfaces 56 which are engaged by the side portions 58 of bridging contactor 40. The cutout section is provided to permit free movement of the hammock 38 during a switching operation.

Figure 6:
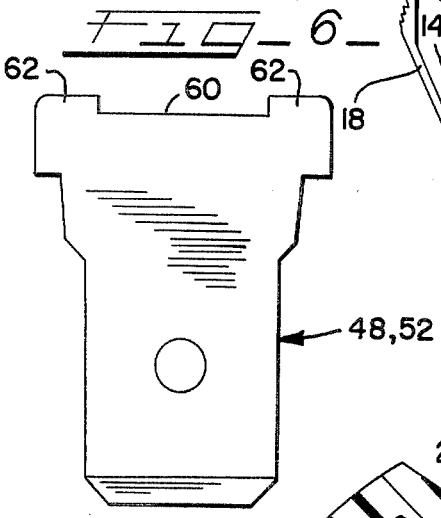
FIG. 6 is an elevational view of a stationary outer contact utilized in the construction; and, FIG. 7 is an elevational view of a stationary intermediate contact utilized in the construction.

The outer contacts 48 and 52 illustrated in FIG. 6 define an upper section including indentation 60. On opposite sides of this indentation, there are provided a pair of stop portions 62. The contacts shown in both FIGS. 6 and 7 preferably consist of blade-like members whereby the configurations designated can be readily formed utilizing simple stamping equipment.

In the operation of the construction, the actuator 22 is employed for determining switch positions. FIG. 2 illustrates the switch in one position, and if the upwardly protruding actuator end is depressed, the bridging contactor 40 will be forced from left to right whereby the opposite switch position is achieved. In the construction described, all three stationary contacts may be connected in a circuit so that the switch will serve to complete a circuit in either position. It will be apparent that one of the contacts 48 and 52 could be open so that the switch will merely serve as an "on-off" switch.

The bridging contactor 40 provides redundant engaging portions for conducting current. Thus, it will be appreciated that in the course of a switching operation, a tab section 44 will be in the first portion of the contact engaging the surface defined by the indentation 60 of a stationary contact. As the bridging contactor completes its movement, the tab section 44 wipes across the surface of indentation 60 thereby minimizing the potential for build-up of contaminants on the engaging surfaces.

As the bridging contactor movement continues, the shoulders 46 of the contactor are driven into engagment with the offset portions 62 of a stationary contact. These offset portions 62 thus act as stops which limit the movement of bridging contactor 40. In addition, the separate engagement of the shoulders with the contact portions 62 provides a separate current path.

The utilization of the shoulders 46 and contact portions 62 also assures maximum use of the spring 32 associated with the actuator 22. Specifically, the provision of means for limiting the actuator movement insures that the actuator will not engage and bear against other portions of the switch housing. In that event, the pressure exerted by the spring 32 would be somewhat diminished whereas with the design of this invention, the spring pressure is all applied to forcing the bridging contactor into engagement with the stationary contact. This arrangement also improves the current conducting capability of the switch.

It will be appreciated that variations in the design of certain portions of the switch are feasible. For example, actuators as described in the prior art patents referred to as well as those otherwise contemplated in this art are useful with the switch design of this invention.

It will further be understood that various other changes and modifications may be made in the construction described which provide the characteristics of the invention without departing from the spirit thereof particularly as defined in the following claims.

That which is claimed is:

1. In a switch construction wherein opposed contacts are positioned on a base, a sliding bridging contactor, and means for sliding the contactor relative to the base whereby the contactor shifts laterally between a first position completing a circuit between the contacts and a second position whereat the contact is out of engagement with at least one contact, the improvement wherein at least one of said opposed contacts comprises an upper section defining separate contactor engaging surfaces, said upper section comprising a blade, a first engaging surface defined by a portion of the upper section, said first engaging surface being defined by a pair of spaced-apart blade portions, and a second engaging surface defined by said upper section, said second engaging surface being offset relative to the first surface, said second surface comprising an indentation formed between said blade portions, said contactor including a shoulder portion movable into engagement with said first surface and a tab section movable into engagement with said second surface, said tab section moving within said indentation, and said shoulder portion including a pair of shoulders formed on opposite sides of said tab section, each of said shoulders being adapted to be pressed into engagement with respective blade portions, engagment of said shoulders with the blade portions limiting the extent of movement of said contactor relative to said upper section, and wherein the separate engagment of the shoulders and the tab section with said upper section provides separate potential current paths in the construction.

2. A construction in accordance with claim 1 including resilient means for urging said contactor against said upper section, said resilient means thereby being adapted to press said shoulder portion of said contactor into engagement with said first surface.

3. A construction in accordance with claim 2 wherein said means for moving the contactor relative to the base comprises a movable actuator, said resilient means being interposed between said actuator and said contactor, and wherein engagement of said shoulder portion with said first surface operates to limit the travel of said actuator so that substantially all the force of the resilient means is utilized for pressing said shoulder portion and tab section into engagement with said surfaces.

4. A construction in accordance with claim 1 wherein one of said upper sections is positioned at each of two spaced locations on said base, and an intermediate conductive contact supported on said base, said contactor being movable between positions bridging one of said upper sections and said intermediate contact.

5. A construction in accordance with claim 4 wherein said intermediate contact provides a fulcrum for said contactor, resilient means adapted to press said contactor into a respective bridging position, and actuator means for shifting said contactor between said bridging positions, said intermediate contact providing for pivoting movement of the contactor during such shifting movement.

6. A construction in accordance with claim 5 wherein said actuator comprises a pivotally mounted button, a hollow stem portion defined by said button, said resilient means comprising a spring positioned within said stem portion, and an actuating piston movable within said stem portion and engaged by said spring, said piston defining an outer end engageable with said contactor whereby pivoting of said button shifts said contactor between said bridging positions.

7. A construction in accordance with claim 6 including a hammock portion defined by said contactor, said outer end of said piston being received in said hammock to provide driving engagement between the piston and contactor.

* * * * *